US005146053A

United States Patent [19]

Powell et al.

[11] Patent Number: 5,146,053

[45] Date of Patent: Sep. 8, 1992

[54] ELEVATOR DISPATCHING BASED ON REMAINING RESPONSE TIME

[75] Inventors: Bruce A. Powell, Canton; John N. Williams, Coventry, both of Conn.

[73] Assignee: Otis Elevator Company, Farmington, Conn.

[21] Appl. No.: 661,966

[22] Filed: Feb. 28, 1991

[51] Int. Cl.[5] ..... B66B 1/18

[52] U.S. Cl. ..... 187/127

[58] Field of Search ..... 187/124, 127

[56] References Cited

U.S. PATENT DOCUMENTS

| | | | |
|---|---|---|---|
| 4,037,688 | 7/1977 | Winkler | 187/127 |
| 4,046,227 | 9/1977 | Kirsch et al. | 187/127 |
| 4,081,059 | 3/1978 | Kuzunuki et al. | 187/127 |
| 4,147,235 | 4/1979 | Henry et al. | 187/127 |
| 4,363,381 | 12/1982 | Bittar | 411/82 |
| 4,760,896 | 8/1988 | Yamaguchi | 187/124 |
| 4,782,921 | 11/1988 | MacDonald et al. | 187/127 |
| 4,784,240 | 11/1988 | MacDonald et al. | 187/127 |
| 4,790,412 | 12/1988 | MacDonald et al. | 187/127 |
| 4,793,443 | 12/1988 | MacDonald et al. | 187/127 |
| 4,799,243 | 1/1989 | Zepke | 377/6 |
| 4,815,568 | 3/1989 | Bittar | 187/127 |
| 4,947,965 | 8/1990 | Kuzunuki et al. | 187/127 |

*Primary Examiner*—A. D. Pellinen
*Assistant Examiner*—Lawrence S. Colbert

[57] ABSTRACT

The present invention is directed to assigning an elevator car in response to a hall call, based on a series of bonuses and penalties and remaining response time, defined herein as an estimation of the amount of time required for an elevator car to reach the floor at which the hall call is registered, given the car calls and hall calls to which the elevator car is committed. Upon the registration of a hall call, a relative system response (RSR) value for each elevator car is determined based on a series of bonuses and penalties. Additionally, a remaining response time (RRT) value for each car is determined. The RRT value of the elevator car having the most favorable RSR value is compared with the RRT value of the elevator car having the lowest RRT value. Based on this comparison, one of the two elevator cars will be assigned to service the hall call. The present invention preferably assigns the hall call to the elevator car which has the lowest RSR value, except where there exists another car which could reach the floor registering the hall call at least a predetermined amount of time before the car having the most favorable RSR value.

9 Claims, 2 Drawing Sheets

ELEVATOR DISPATCHING BASED ON REMAINING RESPONSE TIME

BACKGROUND OF THE INVENTION

1. Technical Field

The present invention is directed to elevator dispatching. More particularly, the present invention is directed to assigning an elevator car to a floor in response to a hall call registered at the floor, based on a series of bonuses and penalties and remaining response time.

As used herein, remaining response time means an estimation of the amount of time required for an elevator car to reach the floor at which the hall call is registered, given the car calls and hall calls to which the elevator car is committed.

2. Background Information

In a building having a plurality of floors, each floor typically has a set of buttons located in the hallway at or near the elevators. These buttons, commonly referred to as hall call buttons, enable users to request elevator car service in a predetermined direction, i.e., up and/or down. Additionally, the interior of an elevator car is generally equipped with a plurality of buttons, commonly referred to as car call buttons, which enable users to request service to specific floors.

In simplified terms, an elevator control system, also referred to in the art as an elevator dispatching system, monitors the status of the hall call buttons at the floors and car call buttons in the elevator cars, assigning elevator cars to the floors in response to hall call and/or car call registration.

As used herein, relative system response, commonly abbreviated RSR, means an elevator dispatching system which employs a series of bonuses and/or penalties to determine which elevator car to assign to a registered hall call. RSR dispatching systems are well known in the art. For example, U.S. Pat. No. 4,363,381 issued to Bittar, entitled *Relative System Response Elevator Call Assignments*, U.S. Pat. No. 4,815,568 to Bittar, entitled *Weighted Relative System Response Elevator Car Assignment System With Variable Bonuses And Penalties*, U.S. Pat. No. 4,782,921 to MacDonald et al., entitled *Coincident Call Optimization In An Elevator Dispatching System*, U.S. Pat. No. 4,790,412 to MacDonald et al., entitled *Anti-Bunching Method For Dispatching Elevator Cars*, and U.S. Pat. No. 4,793,443 to MacDonald et al., entitled *Dynamic Assignment Switching In The Dispatching Of Elevator Cars*, herein incorporated by reference.

In RSR dispatching systems, each elevator car has associated therewith a value for each one of the bonuses and penalties, the values being dependent upon the elevator status, relative to the registered hall call. An RSR value for each elevator car is determined by cumulating the bonuses and penalties for each elevator car, and the elevator car having the most favorable RSR value is assigned to respond to the registered hall call.

Certain penalties of the Bittar systems combine to yield an estimate of the response time of each elevator car to respond to the registered hall call. Some of the various penalties used in the Bittar systems include a run time penalty (RTP) based on the time required for an elevator car to travel between hall and car stops assigned thereto; a travel-through express zone penalty (TRE) based on the time required to travel through the express zone; and a hall stop penalty (HSP) and a car stop penalty (CSP) based on the time delay incurred for each hall stop and car stop, respectively, assigned to the elevator car.

The bonuses of the Bittar systems offset the penalties, thereby favoring an elevator car based on certain conditions. Examples of various bonuses used in the Bittar systems include a coincident car call bonus (CCB) which favors an elevator car having a car call coincident with the floor registering the hall call; a contiguous stop bonus (CSB) which favors an elevator car having a commitment at a floor contiguous with the floor registering the hall call; and a previously-assigned bonus (PAB) which favors the elevator car previously assigned to the hall call.

In the Bittar systems, the RSR value is determined by subtracting the bonuses and adding the penalties, and the elevator car having the lowest RSR value is the most favorable. Similarly, in the MacDonald systems, the RSR value is determined by substracting bonuses from an estimated arrival time, based on items substantially similar to RTP, TRE, HSP and CSP, with the elevator car having the lowest RSR value being the most favorable. The bonuses employed by the MacDonald systems are similar to the CCB (see U.S. Pat. No. 4,782,921), the CSB (see U.S. Pat. No. 4,790,412), and the PAB (see U.S. Pat. No. 4,793,443) of the Bittar systems.

Although these systems are defined such that the lowest RSR value is most favorable, additions and subtractions can be reversed such that the highest RSR value is most favorable.

The RSR determination typically occurs either every cycle, e.g., every 250 milliseconds, or on an "as needed" basis, e.g., whenever an elevator car changes positions, responds to a hall or car call, or whenever a new hall or car call is registered. It is conceivable that the system can reassign the unanswered hall calls to a different elevator car quite often. In order to dampen what might otherwise be an erratic dispatching system, the previously assigned bonus (PAB) is included in the Bittar and MacDonald RSR systems to favor the elevator car which was previously assigned to the unanswered hall call.

The habits and customs of the elevator user dictate the value typically assigned to the previously assigned bonus (PAB). The user predominantly in Europe and the Americas wants to be informed which elevator car will be arriving in response to the hall call shortly before it arrives. Thus, the hall lantern located at or near the arriving elevator car illuminates and/or sounds shortly before the elevator car arrives. In these types of RSR systems, the Bittar systems typically assign a relatively low value to the PAB. Thus, if another elevator car can service an unanswered hall call by at least the PAB value before the assigned car, the unanswered hall call is reassigned to that other car.

The user predominantly in Japan, on the other hand, wants to be informed which elevator car will be responding to the hall call at the time of hall call registration. In this way, the user can wait at the door of the assigned elevator. In these RSR systems, commonly referred to as instantaneous car assignment systems, the elevator car having the most favorable RSR value is almost immediately assigned to the hall call, and the hall lantern located at or near the assigned elevator car illuminates and/or sounds upon assignment. In these types of RSR systems, the Bittar systems typically assign a relatively high value to the PAB, so as to maintain the integrity of the initial car assignment.

There are situations where the initial elevator car assignment, although the best when made, subsequently turns out to be less than satisfactory. For example, in response to an intervening car and/or hall call, the boarding passengers register a plurality of car calls. Additionally, the elevator car, while traveling through the lobby or while responding to an intervening car and/or hall call, gets delayed by boarding passengers who hold the door open, e.g., to wait for others or to finish a conversation with a non-boarding person. Further, an empty elevator car may be assigned a hall call moments before a boarding passenger registers a car call in the direction opposite the assigned hall call.

Due to the large value of PAB, in immediate car assignment systems any one of these situations can drastically extend the system's registration time, defined as the time between when the hall call is registered and when the elevator car is about to arrive in response thereto, as indicated by the hall lantern at or near the arriving elevator car. The maximum registration time is a conventional indicium of overall system responsiveness. In RSR systems employing instantaneous car assignment, some buildings have rather large maximum registration times.

Such large registration times are considered highly unacceptable for at least two reasons. First, a user's irritation level is a function of the amount of time spent waiting for an elevator car. Thus, the longer the wait, the more severe his or her irritation. Second, and more importantly, before the assigned elevator car can get to the floor to service the unanswered hall call, the floor may be bypassed, up-going hall call, by at least one of the other elevator cars; e.g., a car traveling in the up direction travels past a floor having an unanswered up-going hall call.

However, due to the relatively large PAB value, the initially-assigned elevator car remains assigned to the unanswered hall call, despite the fact that at least one other elevator car is bypassing the floor having the unanswered hall call. The other elevator cars do not stop because they do not get the assignment.

SUMMARY OF THE INVENTION

Accordingly, it is an object of the present invention to more efficiently assign an elevator car in response to a hall call in the first instance.

It is a further object of the present invention to assign an elevator car in response to a hall call and to reassign the hall call to another elevator car if the other elevator car can service the hall call at least a predetermined amount of time faster than the previously-assigned elevator car, where the predetermined amount of time is independent of the PAB value.

In accordance with these and other objects, the present invention is directed to assigning an elevator car in response to a hall call based on a series of bonuses and penalties and remaining response time, defined herein as an estimation of the amount of time required for an elevator car to reach the floor at which the hall call is registered, given the car calls and hall calls to which the elevator car is committed.

Upon the registration of a hall call, an RSR value for each elevator car is determined based on a series of bonuses and penalties. Additionally, a remaining response time (RRT) value for each car is determined. The RRT value is an estimate of the amount of time required for an elevator car to reach the floor registering the hall call, given its existing car calls and previously-assigned hall calls. The RRT value of the elevator car having the most favorable RSR value is compared with the RRT value of the elevator car having the lowest RRT value. Based on this comparison, one of the two elevator cars will be assigned to service the hall call.

The present invention preferably assigns the hall call to the elevator car which has the lowest RSR value, except where there exists another car which could reach the floor registering the hall call at least a predetermined amount of time before the car having the most favorable RSR value. In the preferred embodiment, the predetermined amount of time is between about 20 and about 80 seconds, and more preferably about 40 seconds. However, the range and the preferred value is an empirical quantity which is a function of the specific building configuration and its traffic patterns.

After an elevator car is assigned a hall call, the previously-assigned bonus (PAB) is attributed to that elevator car whenever the hall call is subsequently reviewed for reassignment, e.g., every cycle or on an "as needed" basis. In prior art systems, unless the RSR value of other elevator cars is less than the RSR value of the previously-assigned elevator car by at least the value of the PAB, no reassignment takes place. The present invention, on the other hand, will reassign the unanswered hall call to another elevator car if the other elevator car can reach the floor registering the hall call at least a predetermined amount of time before the previously-assigned elevator car, where the predetermined amount of time is independent of the PAB value.

The dispatching methodology of the present invention was simulated for several actual and hypothetical building configurations. For three cases using the instantaneous car assignment feature in actual building configurations, the maximum registration time was reduced 26% to 40%. Where conventional assignment, i.e., non-instantaneous car assignment, was employed, the maximum registration time was reduced about 10%.

DESCRIPTION OF THE PREFERRED EMBODIMENT(S)

In a building having a plurality of floors, each floor typically has a set of buttons located in the hallway at or near the elevators. These buttons, commonly referred to as hall call buttons, enable a user to request elevator car service in a predetermined direction, e.g., up or down. In addition, the interior of an elevator car is generally equipped with a plurality of buttons, commonly referred to as car call buttons, which enable users to request service to specific floors.

An elevator control system, also referred to in the art as an elevator dispatching system, monitors the status of the hall call buttons at the floors, dispatching an elevator car to the floors in response to hall call and/or car call button registration.

Figure 1:
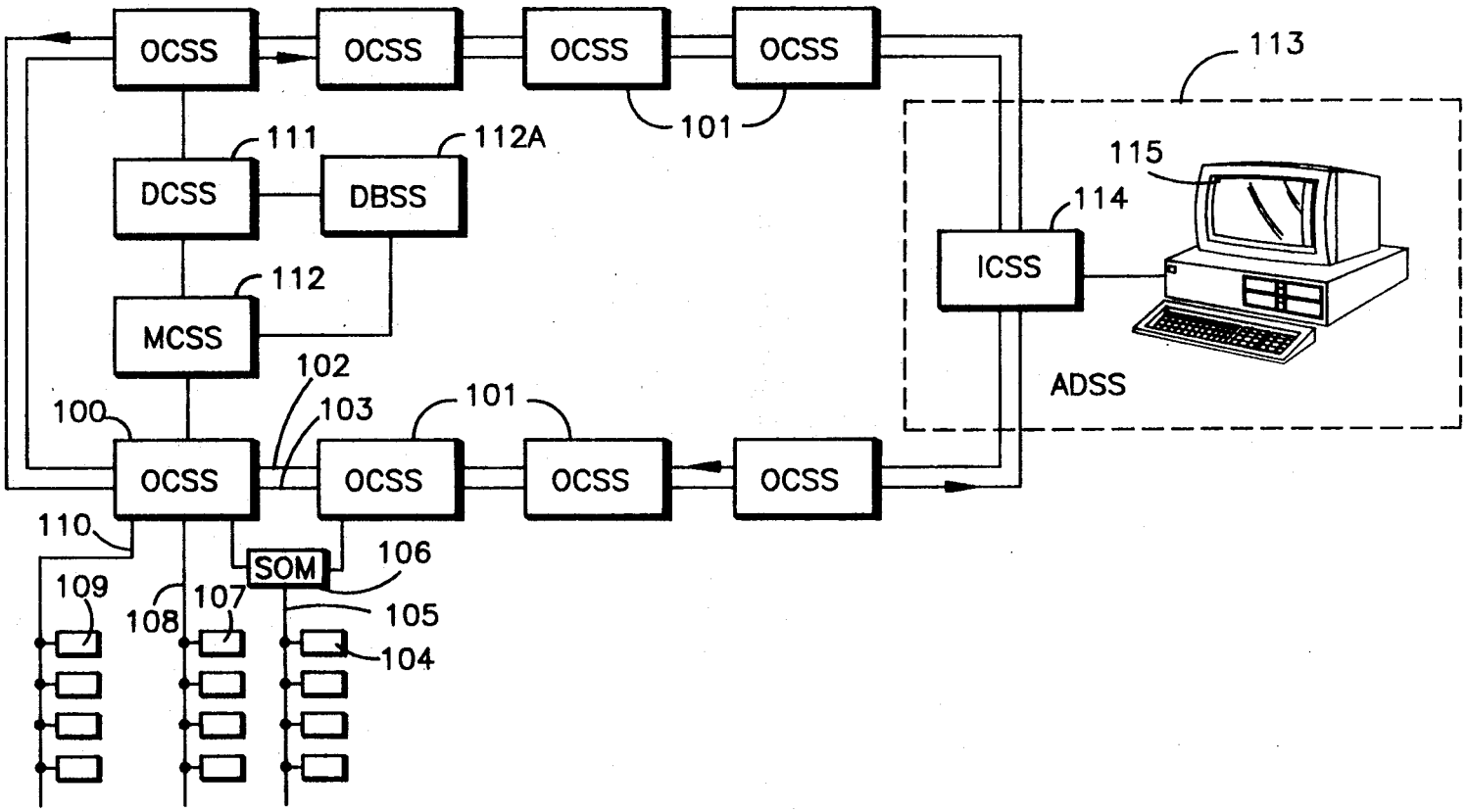
fig. 1 prior art
FIG. 1 depicts an exemplary elevator control system.

An exemplary elevator control system is shown with reference to FIG. 1. It is to be understood, however, that the present invention can be used with any other elevator control system, including, but not limited to, those described in U.S. Pat. No. 4,363,381 to Bittar U.S. application Ser. No. 029,495, filed Mar. 23, 1987, to Auer et al., U.S. Pat. No. 4,037,688 to Winkler, or U.S. Pat. No. 4,046,227 to Kirsch et al., herein incorporated by reference.

Turning now to FIG. 1, an exemplary elevator control system is shown. Each elevator car has operational control subsystem (OCSS) 100, 101 which communicates with every other OCSS in a ring communication system via lines 102, 103. It is to be understood that each OCSS has various circuitry connected thereto. However, for the sake of simplicity, the circuitry associated with only one OCSS 100 will be described.

Hall call buttons and their associated lights and circuitry (not shown) are connected to an OCSS 100 via remote station 104, remote serial communication link 105 and switch-over module 106. Car buttons and their associated lights and circuitry (not shown) are connected to an OCSS via remote station 107 and remote serial communication link 108. Hall fixtures, indicating e.g. the direction of travel of the car which is to stop and/or which set of doors will be opened to accommodate the car which is to stop, and their associated lights and circuitry (not shown) are connected to an OCSS via remote station 109 and remote serial communication link 110.

The operation of the elevator car door is controlled by door control subsystem (DCSS) 111. The movement of the elevator car is controlled by motion control subsystem (MCSS) 112, which operates in conjunction with drive and brake subsystem (DBSS) 112A. Dispatching is determined and executed by the OCSS under the supervisory control of advanced dispatching subsystem (ADSS) 113, which includes a computer 115, communicating via information control subsystem (ICSS) 114.

In the preferred embodiment, the DCSS 111 also determines the load of the elevator car, the load being converted into passenger boarding and/or deboarding counts by the MCSS 112. This information can be sent to the ADSS for recordation and prediction of traffic flow in order to increase the efficiency of elevator service. Alternatively, passenger boarding and/or deboarding counts can be determined by a people sensing-/counting arrangement as shown, e.g., in U.S. Pat. No. 4,799,243 issued to Zepke, incorporated herein by reference.

Figure 2:
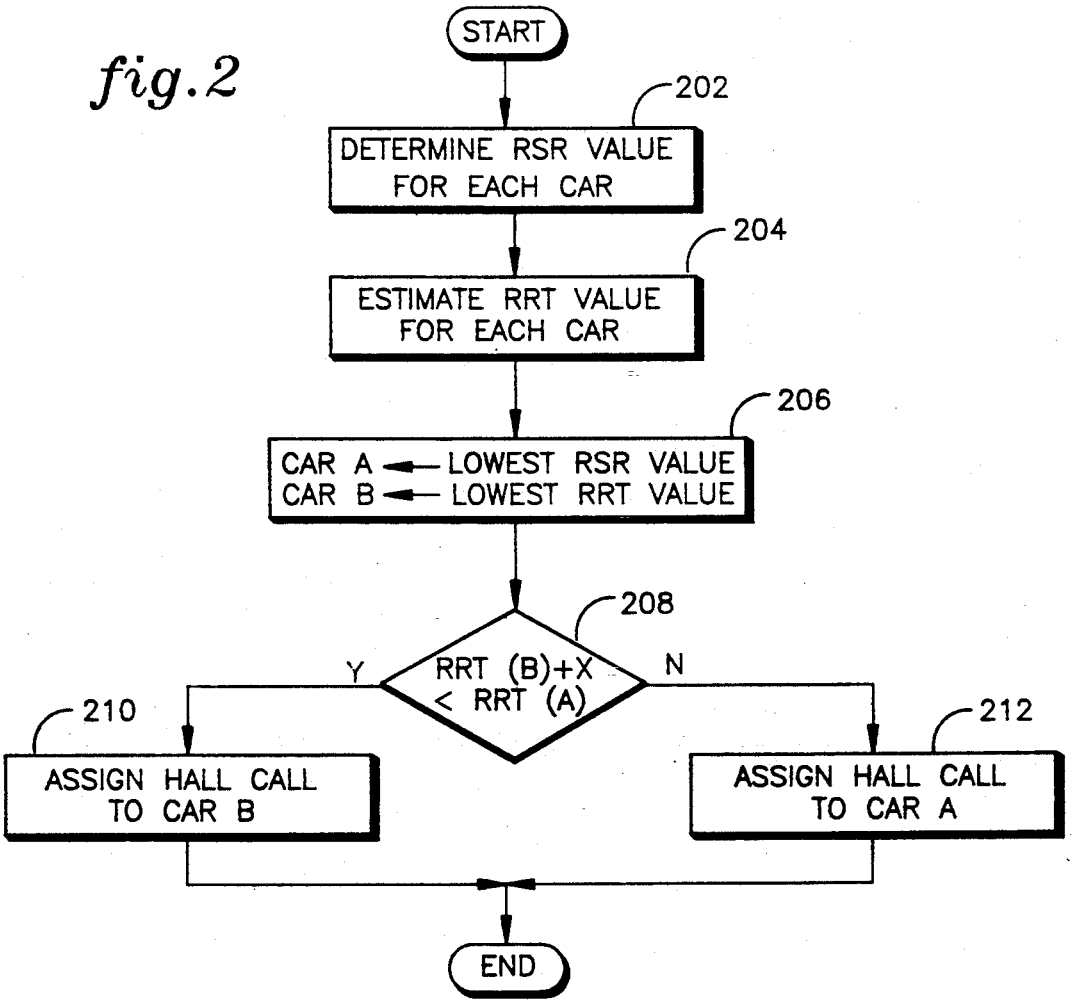
FIG. 2 illustrates a preferred embodiment for assigning and/or reassigning an elevator car in response to a hall call.

Turning now to FIG. 2, a preferred embodiment for assigning and/or reassigning an elevator car in response to a hall call is illustrated. In the preferred embodiment, the elevator dispatching system preferably executes the method of assigning and/or reassigning an elevator car to each new and unanswered hall call either every cycle, e.g., every 250 milliseconds, or on an "as needed" basis, e.g., whenever an elevator car changes positions, responds to a hall or car call, or whenever a new hall or car call is registered.

At step 202, a relative system response (RSR) value for each elevator car is determined. As used herein, RSR value means the value obtained after cumulating a series of bonuses and penalties which comprise the RSR dispatching system. In the preferred embodiment, the RSR system is as disclosed in U.S. Pat. No. 4,815,568 or U.S. Pat. No. 4,363,381, both issued to Bittar. Other RSR systems are known in the art. The present invention is equally applicable regardless of which RSR dispatching system is employed.

In the RSR dispatching systems of Bittar, there are situations where an elevator car can be strongly penalized to reduce its chances of being assigned to the hall call, and thus the RSR value determined for the elevator car is relatively high.

For example, a car can be strongly penalized when its direction of travel is the same as that of the desired direction of the hall call, but the car is moving away from the floor which registered the hall call. Additionally, a car can be strongly penalized where an elevator car traveling in the up direction has a commitment, i.e., car calls and/or previously assigned hall calls, above the floor which registered a down-going hall call. Similarly, a car can be strongly penalized where an elevator traveling in the down direction has a commitment below a floor which registered an up-going hall call. Further, a car can be strongly penalized if its load sensors indicate that the car is fully loaded. As an alternative to penalties, the dispatching system can treat the elevator car as ineligible for assignment to the hall call in question based on these conditions. The present invention is equally applicable regardless of which variation is employed.

At step 204, a remaining response time (RRT) value for each car is determined. The RRT value is an estimate of the amount of time required for an elevator car to reach the floor of the hall call in question, given its existing car calls and previously-assigned hall calls.

In the preferred embodiment, and for the sake of simplicity, the time required to travel between floors, and the time required at each floor to respond to existing car calls and/or previously-assigned hall calls, have fixed time values. For example, the preferred embodiment assumes travel time between floors, where NF represents to require 4.5 seconds plus 1 second per floor, for one less than the number of floors to be traveled. Additionally, the preferred embodiment assumes 6 seconds at each floor to respond to a car call and/or a hall call. However, different values, more complex models and/or variable values based on historic information may be employed.

Figure 3:
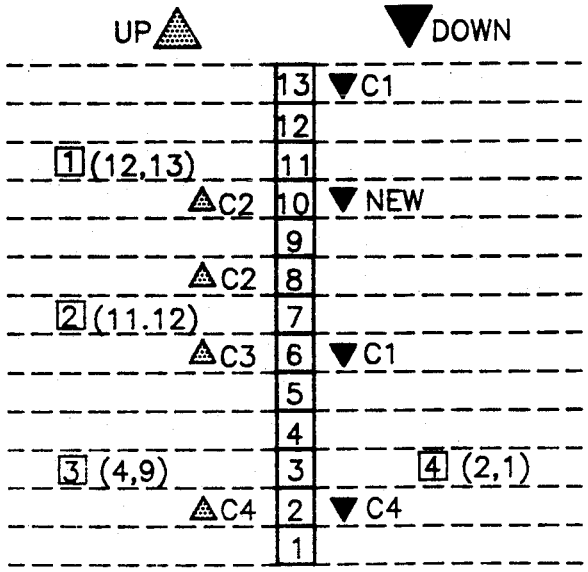
fig.3 prior art
FIG. 3 depicts an example four-car elevator system serving a 13-floor building, with various car calls and hall calls illustrated at an instant in time.

Examples of estimating RRT values in response to a new hall call will now be discussed. With reference to FIG. 3, an example of a four-car elevator system serving a thirteen-floor building is depicted, with various car calls and hall calls illustrated at a particular instant in time. The elevator cars are illustrated as squares which surround the respective elevator car number, with the up-traveling cars on the left, the floor numbers in the center, and the down-traveling elevator cars on the right.

The numbers in parentheses next to each elevator car indicate existing car call commitments associated therewith. Hall calls Ci are positioned at the floors where they have been registered, with up-going hall calls indicated by a triangle positioned to the left of the floor numbers, down-going hall calls indicated by a triangle positioned to the right of the floor numbers, and where "i" represents the number of the elevator car assigned to a hall call. It is to be noted that a new hall call has been registered at floor 10, and has yet to be assigned.

Before Car 1 can reach the new hall call, it must first travel from floor 11 to 12 (4.5 seconds), respond to a car call commitment (6 seconds), travel from floor 12 to 13 (4.5 seconds), respond to a car call commitment and a previously assigned down-going hall call (6 seconds), and travel from floor 13 to 10 (6.5 seconds). Thus, the RRT value for Car 1 is 27.5.

In the preferred embodiment, it is assumed that the down-going hall calls are for lobby service for the purpose of determining an RRT value. Alternatively, one or more car calls to floors other than the lobby can be assumed. Further, it can be assumed that combination car call/hall call stops will take longer than 6 seconds, e.g., 10 seconds.

For Car 2 to reach the new hall call, it must first travel from floor 7 to 8 (4.5 seconds), respond to a previously assigned up-going hall call (6 seconds), travel from floor 8 to 10 (5.5 seconds), respond to a previously assigned up-going hall call (6 seconds), travel from floor 10 to 11 (4.5 seconds), respond to a car call commitment (6 seconds), travel from floor 11 to 12 (4.5 seconds), respond to a car call commitment (6 seconds), and travel from floor 12 to 10 (5.5 seconds). Thus, the RRT value for Car 2 is 48.5.

Alternatively, the RRT estimation can have a factor included for the potential car calls which Car 2 might encounter in response to the up-going hall calls at floor 8 and floor 10. In yet another alternate embodiment, it can be assumed that an up-going hall call will yield a car call to the top floor. In either alternative case, the RRT value would be higher.

As for Car 3, it must travel from floor 3 to 4 (4.5 seconds), respond to a car call commitment (6 seconds), travel from floor 4 to 6 (5.5 seconds), respond to a previously assigned up-going hall call (6 seconds), travel from floor 6 to 9 (6.5 seconds), respond to a car call commitment (6 seconds), potentially respond to a car call from the passenger which boarded at floor 6 in response to the up-going hall call (6 seconds), potential travel from floor 9 to 13 (7.5 seconds) and travel from floor 13 to 10 (6.5 seconds), for an RRT value of 54.5.

Car 4 must travel from floor 3 to 2 (4.5 seconds), respond to a combination car call and hall call (6 seconds), travel from floor 2 to the lobby (4.5 seconds), respond to a car call and let passengers board and deboard at the lobby (6 seconds), potentially travel from the lobby to floor 13 (15.5 seconds), respond to a potential car call (6 seconds), and travel from floor 13 to 10 (6.5 seconds), for an RRT value of 49. Alternatively, it can be assumed that the time required to handle a lobby stop would be greater than 6 seconds, e.g., 20 seconds, and/or that a lobby stop will yield more than one car call, e.g., 3 car calls. Further, it can be assumed that combination car call/hall call stops will take longer than 6 seconds, e.g., 10 seconds.

The simple, fixed-valued factors used in the above examples are for illustrative purposes. Other factors, permutations, complications and variations will be obvious to those skilled in the art.

Returning now to FIG. 2, assuming at step 206 that Car A was the elevator car which had the lowest RSR value, and assuming that Car B had the lowest RRT value, the RRT values of Car A and Car B are compared at step 208.

The present invention preferably assigns the hall call to the elevator car which has the lowest RSR value, except where there exists another car which could reach the floor registering the hall call at least a predetermined amount of time before the car having the most favorable RSR value.

Thus, at step 208, if the RRT value of Car B is less than the RRT value of Car A by at least a predetermined amount of time x, then, at step 210, the hall call is assigned to Car B. Otherwise, at step 212, the hall call is reassigned to Car A.

In the preferred embodiment, predetermined amount of time "x" is between about 20 and about 80 seconds, and more preferably about 40 seconds. However, the range and the preferred value is an empirical quantity which is a function of the specific building configuration and its traffic patterns. As used herein, building configuration means the physical attributes of the building which impact traffic flow therethrough, including but not limited to number of floors, number of elevators, elevator speed, location of express zone(s), location of lobby level and/or parking level(s), total building population, and distribution of the population per floor.

Once an elevator car is assigned a hall call, the previously assigned bonus (PAB), inherent in the RSR calculations of the Bittar systems, is attributed to the elevator car which was assigned the hall call, and comes into play whenever the hall call is subsequently reviewed for reassignment.

In the preferred embodiment, the elevator dispatching system preferably executes the method of assigning and/or reassigning an elevator car to each new and unanswered hall call either every cycle or on an "as needed" basis. Alternatively, steps 204 through 212 may be executed every nth cycle. In this way, RRT value determination and the potential reassignment therefrom occurs, e.g., once every 2, 5, 10, 15, 30, 45 or 60 seconds.

In prior art systems, unless the RSR value of other elevator cars is less than the RSR value of the previously-assigned elevator car by at least the value of the PAB, no reassignment takes place. The present invention, on the other hand, will reassign the unanswered hall call to another elevator car if the other elevator car can reach the floor registering the hall call at least a predetermined amount of time before the previously-assigned elevator car, where the predetermined amount of time is independent of the PAB value.

As stated above, registration time is the time between when the hall call is registered and when the elevator car is about to arrive in response thereto, as indicated by the hall lantern at or near the arriving elevator car. The maximum registration time is commonly used as an indicia of the dispatching system's efficiency.

The dispatching methodology of the present invention was simulated for several actual and hypothetical building configurations. For three cases using the instantaneous car assignment feature in actual building configurations, the maximum registration time was reduced 26%, 34% and 40%. Where conventional assignment, i.e., non-instantaneous car assignment, was employed, the maximum registration time was reduced about 10%.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. In a building having a predetermined number of floors, a predetermined floor having a hall call button for requesting service in a predetermined direction, an elevator control system controlling the assignment of elevator cars in response to a hall call registered at the predetermined floor, a method of assigning an elevator car to service the call based on the response time of an elevator to reach the predetermined floor, said method comprising the steps of:

determining, for each elevator car, a relative system response (RSR) value based on a plurality of predetermined bonuses and penalties;

determining which elevator car has the most favorable RSR value;

estimating, for each elevator car, a remaining response time (RRT) value based on the amount of time required for the elevator to reach the predetermined floor given car calls and hall calls to which the elevator car is committed;

determining which elevator car has the lowest RRT value;

comparing the RRT value of the car determined to have the most favorable RSR value to the RRT value of the car determined to have the lowest RRT value; and assigning an elevator car to respond to the hall call based on said comparison.

2. The method of claim 1, wherein the step of assigning an elevator car comprises the step of:

assigning the hall call to the elevator car having the lowest RRT value, provided that the RRT value of the car having the lowest RRT value is less than the RRT value of the car having the most favorable RSR value by at least a predetermined amount of time.

3. The method of claim 2, wherein said predetermined amount of time is between about 20 and about 80 seconds.

4. The method of claim 3, wherein said predetermined amount of time is about 40 seconds.

5. The method of claim 2, wherein said predetermined amount of time is empirically determined based on building configuration and its traffic patterns.

6. The method of claim 1, wherein the step of assigning an elevator car comprises the steps of:

assigning the hall call to the elevator car having the lowest RRT value, provided that the RRT value of the car having the lowest RRT value is less than the RRT value of the car having the most favorable RSR value by at least a predetermined amount of time; otherwise, assigning the hall call to the elevator car having the most favorable RSR value.

7. The method of claim 6, wherein said predetermined amount of time is between about 20 and about 80 seconds.

8. The method of claim 7, wherein said predetermined amount of time is about 40 seconds.

9. The method of claim 6, wherein said predetermined amount of time is empirically determined based on building configuration and its traffic patterns.

* * * * *